US007023388B2

(12) United States Patent
Shimabara

(10) Patent No.: US 7,023,388 B2
(45) Date of Patent: Apr. 4, 2006

(54) MULTIPLE RESONANCE ANTENNA AND MOBILE PHONE ANTENNA

(75) Inventor: Masataka Shimabara, Warabi (JP)

(73) Assignee: Nippon Antena Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/486,292

(22) PCT Filed: May 26, 2003

(86) PCT No.: PCT/JP03/06531

§ 371 (c)(1),
(2), (4) Date: Feb. 9, 2004

(87) PCT Pub. No.: WO03/105277

PCT Pub. Date: Dec. 18, 2003

(65) Prior Publication Data

US 2004/0246186 A1 Dec. 9, 2004

(30) Foreign Application Priority Data

Jun. 10, 2002 (JP) ..... 2002-168540

(51) Int. Cl.
*H01Q 1/24* (2006.01)

(52) U.S. Cl. ..... 343/702; 343/833

(58) Field of Classification Search ..... 343/702, 343/895, 833

See application file for complete search history.

(56) References Cited

U.S. PATENT DOCUMENTS

| | | | | |
|---|---|---|---|---|
| 6,329,962 | B1 | 12/2001 | Ying | 343/895 |
| 6,351,241 | B1 * | 2/2002 | Wass | 343/702 |
| 6,559,811 | B1 | 5/2003 | Pulimi et al. | 343/895 |
| 6,642,893 | B1 * | 11/2003 | Hebron et al. | 343/702 |

FOREIGN PATENT DOCUMENTS

| | | |
|---|---|---|
| EP | 0 964 474 | 12/1999 |
| JP | 06-037531 | 2/1994 |
| JP | 10-209736 | 8/1998 |
| JP | 11-330825 | 11/1999 |
| JP | 11-355029 | 12/1999 |
| JP | 2000-040912 | 2/2000 |
| JP | 2003-324305 | 11/2003 |
| WO | WO 97/02622 | 1/1997 |
| WO | WO 97/49141 | 12/1997 |
| WO | WO 99/48169 | 9/1999 |
| WO | WO 01/08260 | 2/2001 |

* cited by examiner

*Primary Examiner*—Shih-Chao Chen
(74) *Attorney, Agent, or Firm*—Kirk Hahn

(57) ABSTRACT

With the object of forming a compact antenna that operates in a plurality of frequency bands, the pattern of an antenna element (14) that can resonate in a plurality of frequency bands is formed on the outer circumferential surface of an antenna bobbin (12). A parasitic conductor (11) is inserted into an accommodating hole, which is formed substantially along the central axis of this antenna bobbin (12). As a result, an antenna that operates favorably in the frequency bands of AMPS, PCS and GPS can be obtained.

7 Claims, 15 Drawing Sheets

MULTIPLE RESONANCE ANTENNA AND MOBILE PHONE ANTENNA

This application is the U.S. National Phase under 35 U.S.C. §371 of International Application PCT/JP03/06531, filed May 26, 2003, which claims priority of Japanese Patent Application No. 2002-168640, filed Jun. 10, 2002 in the name of NIPPON ANTENA KABUSHIKI KAISHA. The International Application was published under PCT Article 21(2) in a language other than English.

TECHNICAL FIELD

The present invention relates to a multiple resonance antenna which operates in a plurality of frequency bands, and a mobile phone antenna.

BACKGROUND ART

The frequency band used by mobile phone systems is generally considered to be a plurality of frequency bands. For example, in the case of PDC systems (personal digital cellular telecommunication systems) in Japan, the 800 MHz band (810 MHz to 956 MHz) and the 1.4 GHz band (1429 MHz to 1501 MHz) are used, and in the case of digital cellular systems in the United States, at least the 900 MHz band (824 MHz to 894 MHz) is used for AMPS (advanced mobile phone service) systems, and the 1.8 GHz band (1850 MHz to 1990 MHz) is used for PCS (personal communication service) systems. Furthermore, in Europe, the 900 MHz band (870 MHz to 960 MHz) is used for GSM (global system for mobile communications) systems, and the 1.8 GHz band (1710 MHz to 1880 MHz) is used for DCS (digital cellular system) systems. The reason for such use of a plurality of frequency bands is that the number of frequencies that can be utilized in a single frequency band is insufficient due to an increase in the number of subscribers.

Furthermore, in the case of mobile phones, GPS receivers for GPS systems in which the satellite transmission frequency is set at approximately 1575 MHz have been incorporated into the apparatus. The mounting of an antenna which operates in a plurality of frequency bands is required in mobile phones that thus receive or transmit a plurality of frequency bands. Conventionally, therefore, a planar antenna or small-volume chip antenna has been installed inside the wireless apparatus housing as an antenna that operates in a plurality of frequency bands in addition to the main externally mounted antenna. In such cases, however, the antenna occupies volume inside the wireless apparatus housing, and interferes with the compact construction of the wireless apparatus. Furthermore, when the user grips the mobile phone, the proportion of the internal antenna that is covered by the hand is large, so that there is a deterioration in the antenna characteristics during the use of the mobile phone.

Furthermore, there is also a method in which a single-element helical antenna is used, and this is formed into a multiple resonance antenna by forcibly causing multiple resonance by means of an impedance matching circuit. However, in the case of a retractable antenna using a combination of a single-element whip antenna or helical antenna and a matching circuit, it is difficult to obtain satisfactory antenna electrical characteristics in a plurality of frequency bands. Moreover, it is conceivable that antenna elements that operate independently at respective frequency bands in a plurality of frequency bands might be used as an antenna; in such a case, however, a number of antenna elements equal to the number of frequency bands is required, so that the antenna cannot be made compact, and application is a mobile phone is difficult.

Accordingly, it is an object of the present invention to provide a compact multiple resonance antenna and mobile phone antenna which operate favorably in a plurality of frequency bands.

DISCLOSURE OF THE INVENTION

In order to solve the abovementioned problems, the multiple resonance antenna of the present invention comprises an insulating antenna bobbin which has the pattern of an element that resonates in a plurality of frequency bands formed on the outer circumferential surface, and a conductive parasitic conductor which is inserted into, an accommodating hole formed substantially along the central axis of this antenna bobbin.

Furthermore, in the multiple resonance antenna of the present invention, the lower part of the antenna bobbin may be engaged with a conductive antenna holder, this antenna holder and the element may be electrically connected, and an insulating cap part which covers the antenna bobbin may be mounted on the upper part of the antenna holder.

Furthermore, in the abovementioned multiple resonance antenna of the present invention, the pattern of the element may be formed so that this pattern is folded back, and a short-circuiting part that connects the folded-back portions of the pattern may be formed.

Next, the mobile phone antenna of the present invention which can solve the abovementioned problems is a mobile phone antenna comprising a fixed antenna part which can be fastened to the housing of the mobile phone, and a retractable antenna part which passes through the fixed antenna part, and is retractable with respect to this fixed antenna part. The fixed antenna part is constructed from an insulating antenna bobbin which has the pattern of an element that resonates in a plurality of frequency bands formed on the outer circumferential surface, a conductive parasitic conductor which is inserted into a through-hole that is formed substantially along the central axis of the antenna bobbin, a conductive antenna holder with which the lower part of the antenna bobbin is engaged, and to which the element is electrically connected, and an insulating cap part which covers the antenna bobbin, and the retractable antenna part is constructed from a whip part, a conductive stopper which is installed on the lower end of the whip part, and which is held inside an antenna through hole that is formed substantially along the central axis of the fixed antenna part when the retractable antenna part is extended, and an insulating part which is disposed on the tip end of the whip part, and which is positioned inside the antenna through-hole when the retractable antenna part is retracted.

Furthermore, in the mobile phone antenna of the present invention, a conductive expanded-diameter part may be formed at an intermediate point on the whip part, and this expanded-diameter part may be positioned inside the through-hole in the antenna bobbin when the whip part is extended.

Furthermore, in the mobile phone antenna of the present invention, a conductive part may be installed at a point that is positioned inside the antenna through-hole when contracted in the insulating part, instead of the abovementioned parasitic conductor.

Moreover, in the mobile phone antenna of the present invention, a conductive contact spring which contacts the inside of the through-hole in the parasitic conductor when the whip part is extended may be installed instead of the expanded-diameter part.

Furthermore, in the mobile phone antenna of the present invention, a conductive film may be formed, instead of the abovementioned parasitic conductor, on the inner circumferential surface of the through-hole in the antenna bobbin.

In the present invention described above, since a conductive parasitic conductor is inserted into an accommodating hole in an insulating antenna bobbin on which the pattern of an element that resonates in a plurality of frequency bands is formed, a multiple resonance antenna with good electrical characteristics which can be operated in a plurality of frequency bands can be obtained. Furthermore, this antenna can be made compact.

Furthermore, if such a multiple resonance antenna is formed so that this antenna can be fastened to a housing as a fixed antenna part, and a mobile phone antenna is constructed from this fixed antenna part and a retractable antenna part which passes through the fixed antenna part and is retractable with respect to this fixed antenna part, a compact mobile phone antenna with good electrical characteristics which can be operated in a plurality of frequency bands can be obtained. In this case, the electrical characteristics in the extended state can be further improved by positioning an expanded-diameter part formed at an intermediate point on the retractable antenna part inside the through-hole in the antenna bobbin when the retractable antenna part is extended.

BEST MODE FOR CARRYING OUT THE INVENTION

Figure 1:
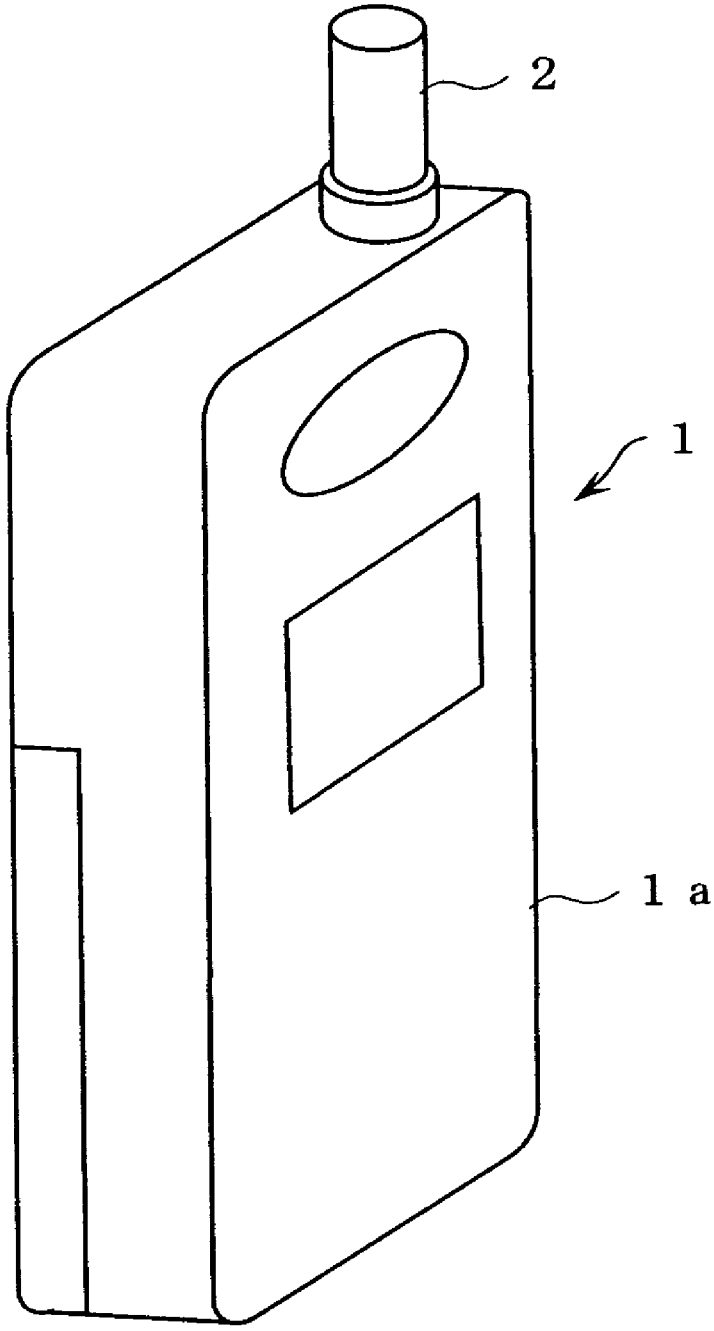
FIG. 1 is a diagram which shows the construction of a mobile phone equipped with a multiple resonance antenna constituting an embodiment of the present invention.

The construction of a mobile phone equipped with a multiple resonance antenna constituting an embodiment of the present invention is shown in FIG. 1.

The mobile phone 1 shown in FIG. 1 comprises a wireless apparatus housing 1*a* in which a telephone functional circuit part and a battery are accommodated. Various buttons including a dial button, as well as a display, are disposed on the front surface of the wireless apparatus housing 1*a*. Furthermore, a fixed antenna part 2 which is a multiple resonance antenna according to the present invention is mounted on the upper surface of the wireless apparatus housing 1*a*. For example, this fixed antenna part 2 is formed as an antenna that can operate in three frequency bands, i.e., 900 MHz band of the AMPS system, the 1.8 GHz band of the PCS system, and the GPS system in which the satellite transmission frequency is set at approximately 1575 MHz.

Figure 2:
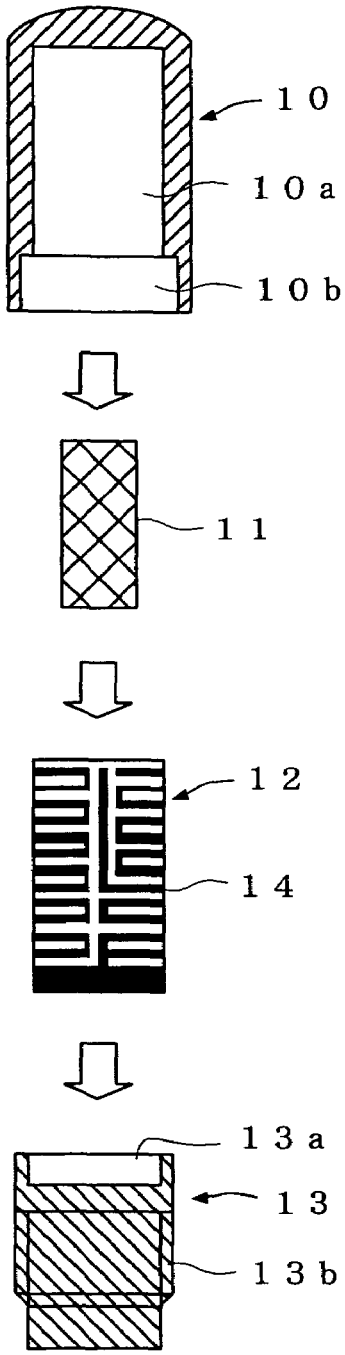
FIG. 2 is an exploded assembly diagram which shows the construction of the fixed antenna part in an embodiment of the multiple resonance antenna of the present invention.
Figure 3:
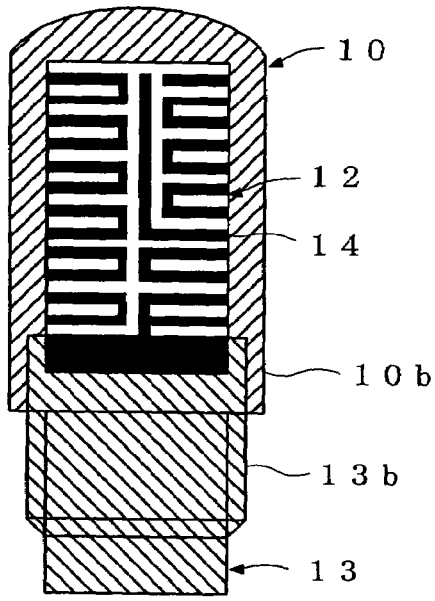
FIG. 3 is a sectional view which shows the construction of the fixed antenna part in an embodiment of the multiple resonance antenna of the present invention.
Figure 4:
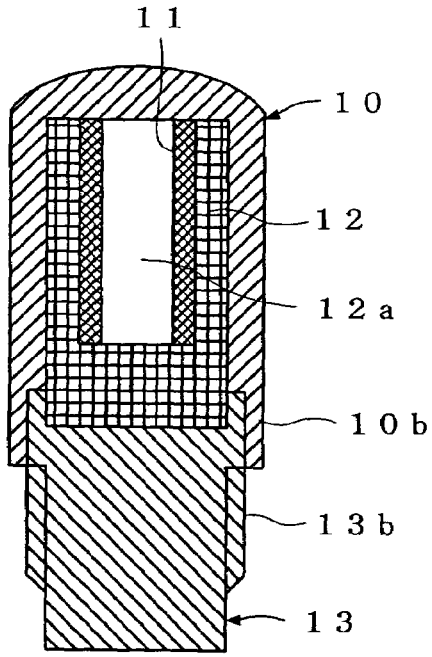
FIG. 4 is a sectional view which shows the construction of the fixed antenna part in an embodiment of the multiple resonance antenna of the present invention.

Next, an exploded assembly diagram of the fixed antenna part 2 is shown in FIG. 2, and the construction of the fixed antenna part 2 is shown in FIGS. 3 and 4. However, FIG. 3 shows a sectional view in which the parts other than the antenna bobbin are cut away, and FIG. 4 shows a sectional view in which parts including the antenna bobbin are cut away.

In these figures, for example, a screw part 13*b* is formed on the outer circumferential surface of a conductive antenna holder 13 which is made of metal, and a recessed insertion part 13*a* is formed in the upper surface of this antenna holder 13. The lower part of an antenna bobbin 12 is inserted into this insertion part 13*a*. The antenna bobbin 12 comprises an insulating material such as a synthetic resin or the like, and is formed with a substantially circular cross-sectional shape. The pattern of an antenna element 14 that resonates in a plurality of frequency bands as will be described later is formed on the outer circumferential surface of the antenna bobbin 12. This pattern is formed as a conductive film on the outer circumferential surface of the antenna bobbin 12 by conductive foil printing, conductive powder vacuum evaporation, plating or the like, and is formed as a ring-form pattern on the lower part of the antenna bobbin 12. This ring-form pattern is located in a position which is such that this pattern is electrically connected with the antenna holder 13 when the antenna bobbin 12 is inserted into the insertion part 13*a* of the antenna holder 13.

An accommodating hole 12*a* is formed along the central axis of the antenna bobbin 12 mounted in the antenna holder 13 so that this hole substantially corresponds to the position where an antenna element 14 is formed. Furthermore, a conductive parasitic conductor 11 which is made of for example a metal and which is formed in a cylindrical shape is inserted into this accommodating hole 12*a*. In this state, an insulating cap part 10 made of for example a synthetic resin is mounted from above so that the antenna bobbin 12 is accommodated inside the accommodating part 10*a* of this cap part 10. Furthermore, an engaging part 10*b* disposed on the lower part of the cap part 10 is engaged and fastened to the upper part of the antenna holder 13. The antenna holder 13 of the fixed antenna part 2 constructed in this manner is inserted into a through-hole formed in the upper surface of the wireless apparatus housing 1*a*, and a holder nut is screwed onto the screw part 13*b* of the antenna holder 13 from the inside of the wireless apparatus housing 1*a*, so that the fixed antenna part 2 is fastened to the wireless apparatus housing 1*a*. In this case, terminals contact the antenna holder 13 so that the fixed antenna part 2 and the wireless apparatus circuit contained in the wireless apparatus housing 1*a* are electrically connected.

Figure 5:
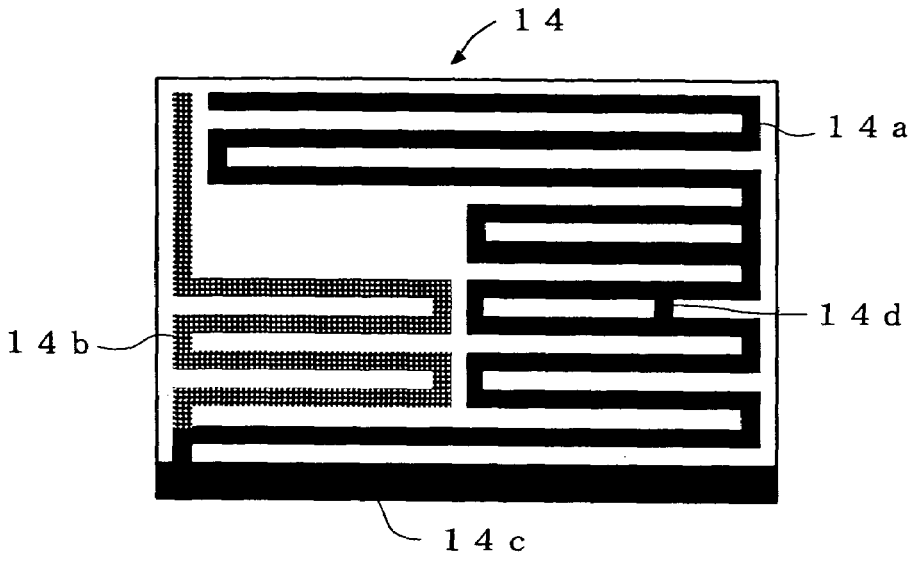
FIG. 5 is a diagram which shows a first pattern example of the antenna element in the fixed antenna part of an embodiment of the multiple resonance antenna of the present invention.

Here, an unfolded view of a first pattern example of the pattern of the antenna element 14 formed on the outer circumferential surface of the antenna holder 13 is shown in FIG. 5.

In this first pattern example, as is shown in FIG. 5, the antenna element 14 is constructed from a first element 14*a* and a second element 14*b*. The first element 14*a* and second element 14*b* are formed so that these elements are folded back a plurality of times in order to shorten the height, and short-circuiting parts 14*d* that short-circuit specified locations between the folded-back portions of the pattern are formed in several places. Furthermore, the lower ends of the first element 14*a* and second element 14*b* are connected to a feeder part 14*c*, and this feeder part 14*c* forms a ring-form pattern that is contacted as a result of insertion into the insertion part 13*a* of the antenna holder 13.

Figure 6:
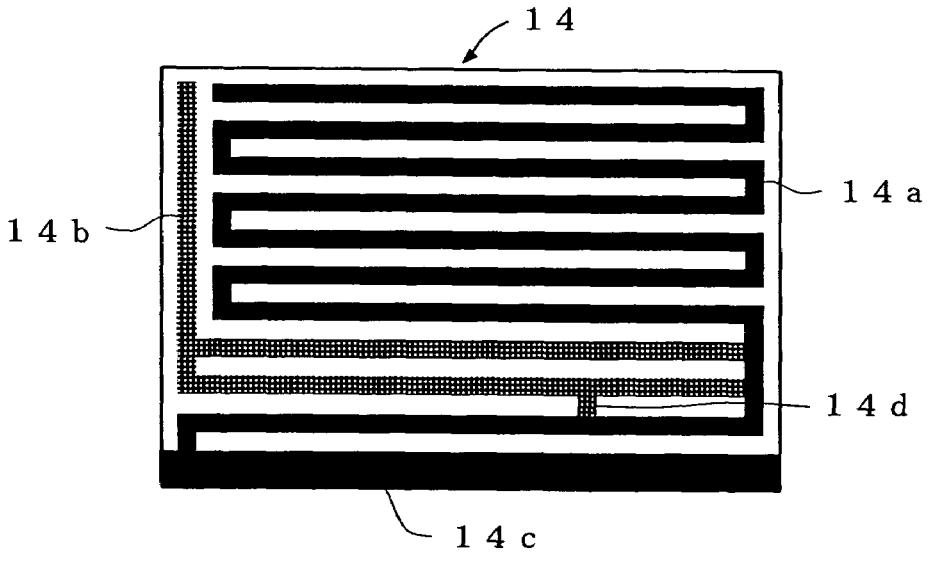
FIG. 6 is a diagram which shows a second pattern example of the antenna element in the fixed antenna part of an embodiment of the multiple resonance antenna of the present invention.

Next, an unfolded view of a second pattern example of the pattern of the antenna element 14 formed on the outer circumferential surface of the antenna holder 13 is shown in FIG. 6. In this second pattern example, as is shown in FIG. 6, the antenna element 14 is constructed from a first element 14*a* and a second element 14*b*. As in the case of the first pattern example, the first element 14*a* and second element 14*b* are formed so that these elements are folded back a plurality of times in order to shorten the height; however, the pattern shape that is folded back is different. Furthermore, short-circuiting parts 14*d* that short-circuit specified locations between the folded-back portions of the pattern are formed in several places. Moreover, the lower end of the first element 14*a* is connected to a feeder part 14*c*, and the lower end of the second element 14*b* is connected to an intermediate point on the first element 14*a*. The feeder part 14*c* forms a ring-form pattern that is contacted as a result of insertion into the insertion part 13*a* of the antenna holder 13.

In cases where the fixed antenna part 2 in which an antenna element 14 formed with the first pattern example or second pattern example is formed on the outer circumferential surface of the antenna bobbin 12 is set so as to be operable in three frequency bands, i.e., the 900 MHz band of the AMPS system, the 1.8 GHz band of the PCS system, and the GPS system in which the satellite transmission frequency is set at approximately 1575 MHz, the first element 14*a* operates mainly in the frequency band of the AMPS system, and the second element 14*b* operates mainly in the PCS system and GPS system. However, since the first element 14*a* and second element 14*b* are disposed in close proximity to each other, these elements do not operate independently, but rather influence each other. As a result, the antenna element 14 as a whole can operate in the three frequency bands of the AMPS system, PCS system and GPS system. Furthermore, since a parasitic conductor 11 which is inserted into the accommodating hole 12*a* of the antenna bobbin 12 is disposed in close proximity to the pattern of such an antenna element 14, the antenna element 14 is influenced by the parasitic conductor 11, so that the electrical characteristics are improved to good electrical characteristics in the frequency bands of the AMPS system, PCS system and GPS system, and a fixed antenna 2 that can operate in the three frequency bands is obtained. Moreover, the impedance of the fixed antenna part 2 in the frequency bands in which this antenna part can operate is approximately 50 Ω; accordingly, a matching circuit for matching with the wireless apparatus circuit can be omitted.

Figure 7:
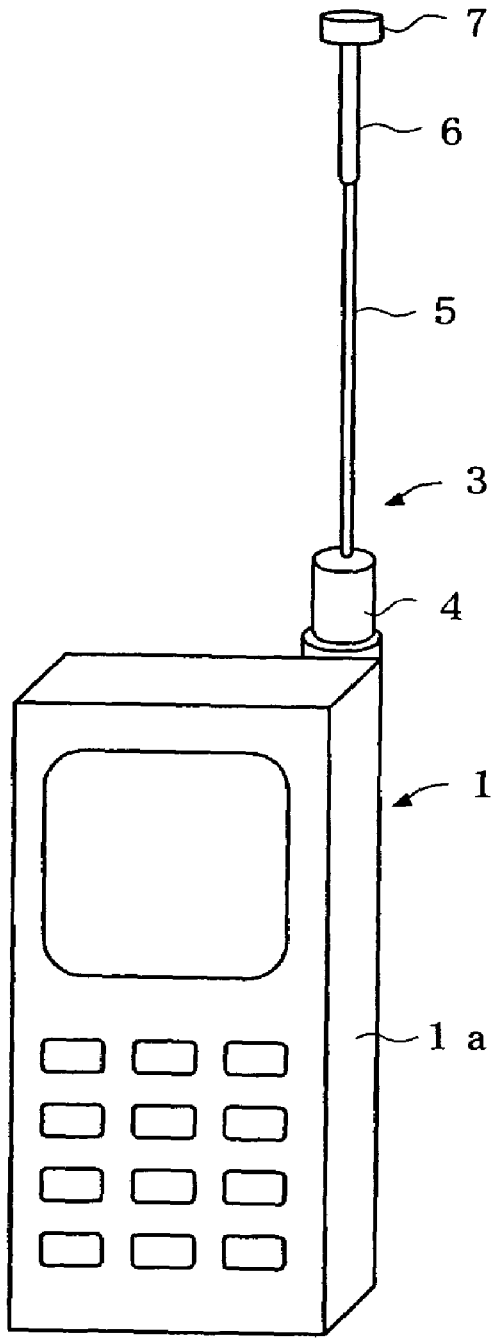
FIG. 7 is a diagram which shows the construction of a mobile phone equipped with a mobile phone antenna constituting an embodiment of the present invention.
Figure 8:
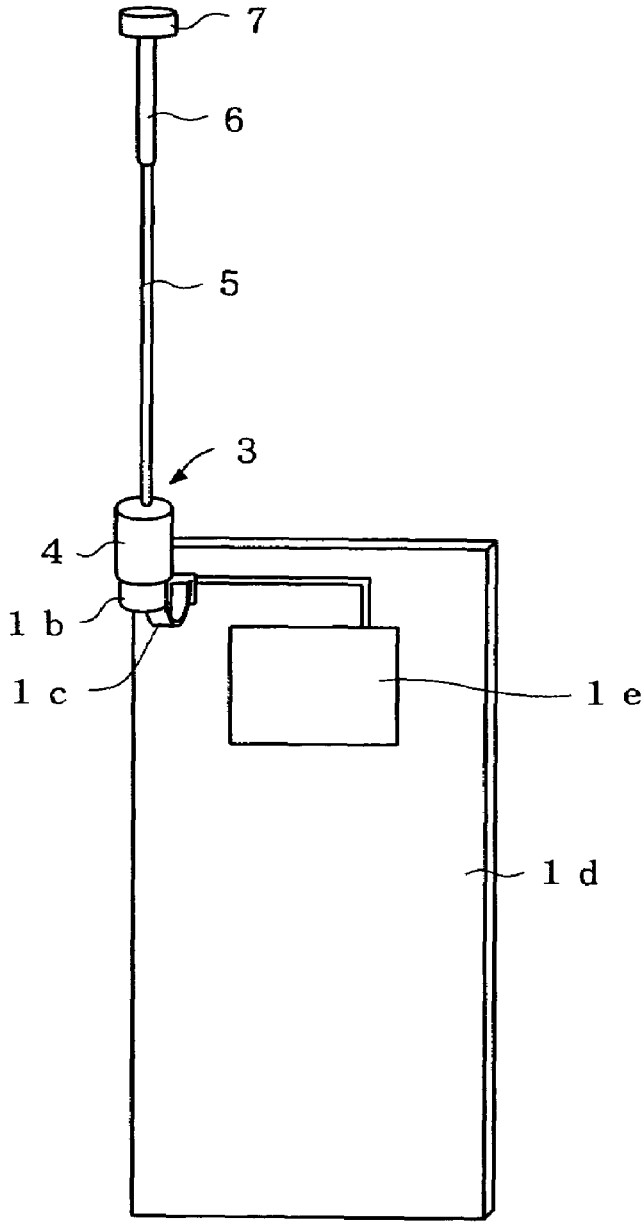
FIG. 8 is a diagram which shows the relationship between a mobile phone antenna constituting an embodiment of the present invention and a circuit board contained in a mobile phone.

The construction of a mobile phone equipped with a mobile phone antenna constituting an embodiment of the present invention is shown in FIG. 7, and the relationship between the mobile phone antenna and the circuit board contained in the mobile phone is shown in FIG. 8.

The mobile phone 1 shown in FIG. 7 comprises a wireless apparatus housing 1*a* in which a telephone functional circuit part and a battery are accommodated. Various buttons including a dial button, as well as a display, are disposed on the front surface of the wireless apparatus housing 1*a*. Furthermore, a mobile phone antenna 3 according to the present invention is fastened to the upper surface of the wireless apparatus housing 1*a*. This mobile phone antenna 3 is formed as an antenna that can operate in three frequency bands, i.e., the 900 MHz band of the AMPS system, the 1.8 GHz band of the PCS system, and the GPS system in which the satellite transmission frequency is set at approximately 1575 MHz.

The mobile phone antenna 3 is constructed from a fixed antenna part 4 and a retractable antenna part 5. The fixed antenna part 4 is arranged so that this fixed antenna part 4 is fastened to the wireless apparatus housing 1*a*. Furthermore, the retractable antenna part 5 is arranged so as to pass through the fixed antenna part 4, and to be retractable with respect to the fixed antenna part 4. The fixed antenna part 4 is inserted into a through-hole formed in the upper surface of the wireless apparatus housing 1*a*, and a holder nut 1*b* is screwed onto the lower part of the fixed antenna part 4 from the inside of the wireless apparatus housing 1*a* as shown in FIG. 8, so that the fixed antenna part 4 is fastened to the wireless apparatus housing 1*a*. In this case, a contact terminal 1*c*, one end of which is soldered to a circuit board 1*d*, contacts the feeder part of the fixed antenna part 4, so that an RF circuit 1*e* disposed on the circuit board 1*d* and the fixed antenna part 4 are electrically connected. Furthermore, since the impedance of the mobile phone antenna 3 is approximately 50 Ω in the operable frequency bands, a matching circuit used to match of the mobile phone antenna 3 and RF circuit 1*e* can be omitted.

Figure 9:
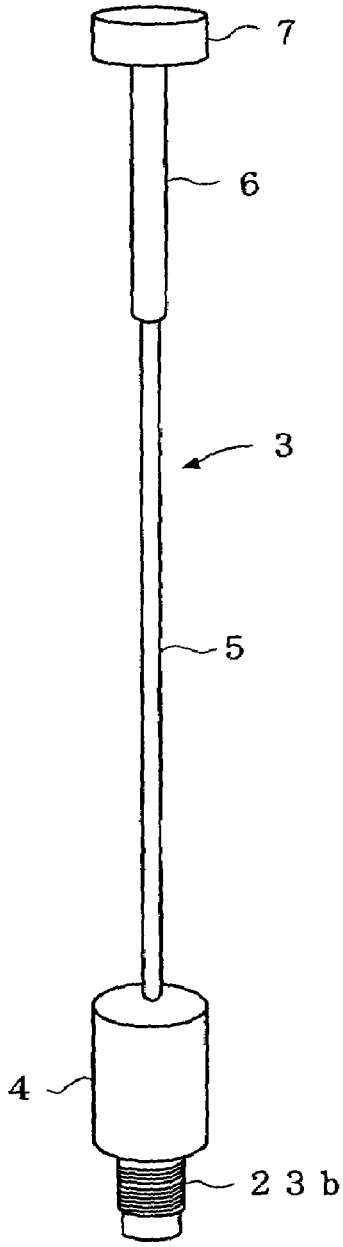
FIG. 9 is a diagram which shows the overall construction of a mobile phone antenna constituting an embodiment of the present invention.
Figure 10:
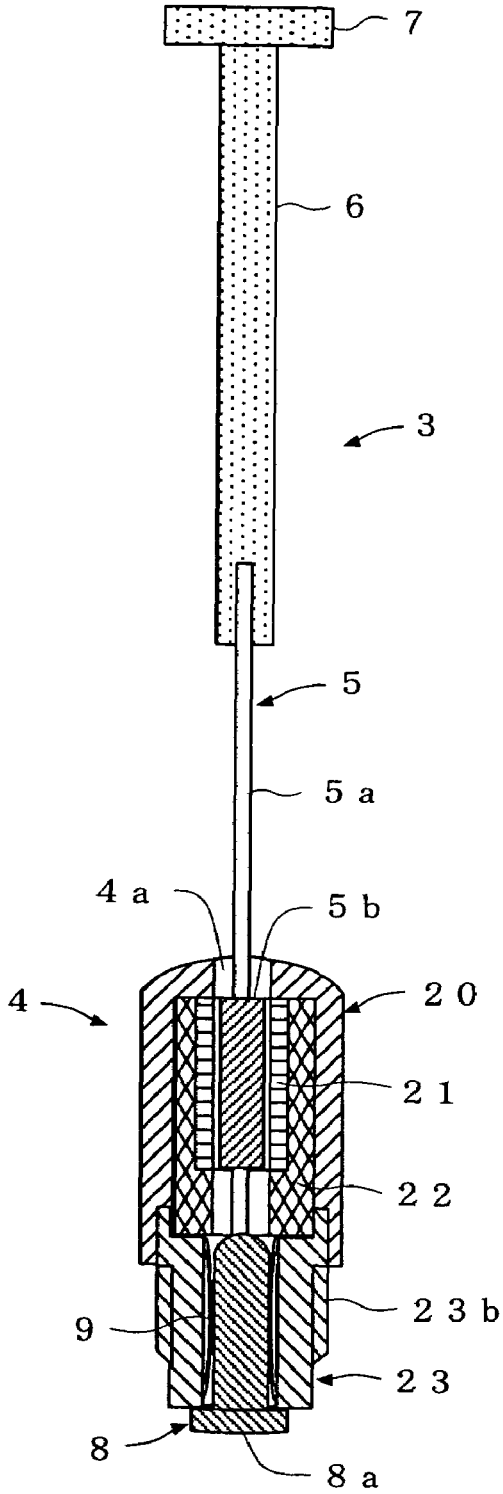
FIG. 10 is a diagram showing the construction when the retractable antenna part is extended in a mobile phone antenna constituting an embodiment of the present invention.
Figure 11:
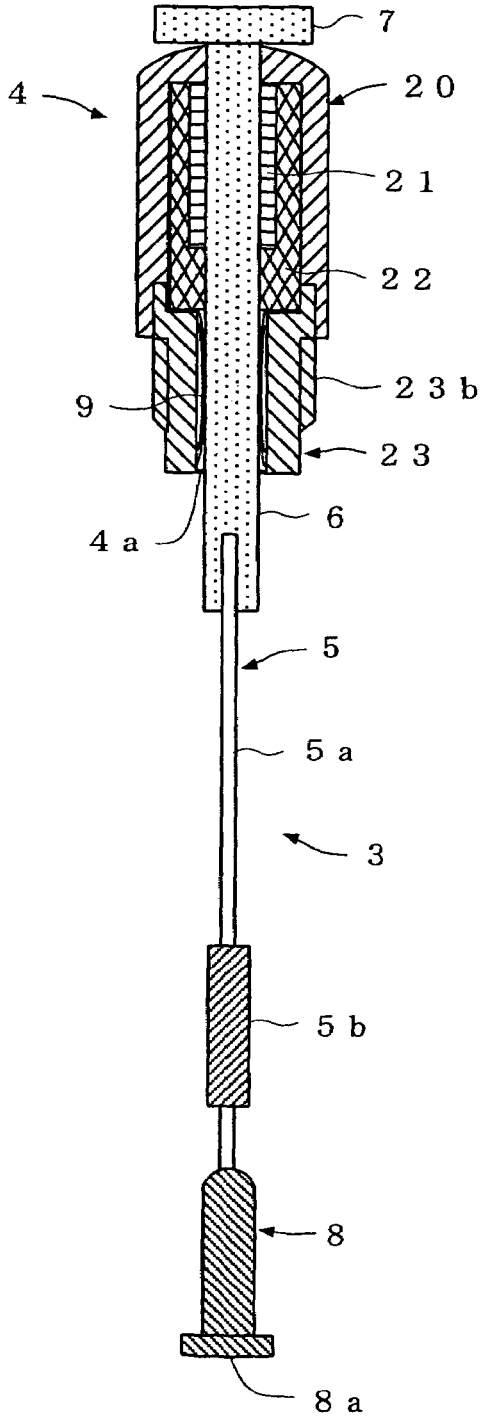
FIG. 11 is a diagram showing the construction when the retractable antenna part is retracted in a mobile phone antenna constituting an embodiment of the present invention.

Next, the overall construction of the mobile phone antenna 3 of the present invention is shown in FIG. 9, a sectional view showing a state in which the retractable antenna part 5 is extended is shown in FIG. 10, and a sectional view showing a state in which the retractable antenna part 5 is retracted is shown in FIG. 11.

As is shown in these figures, the fixed antenna part 4 has a through-hole 4*a* formed throughout, and is constructed from an antenna bobbin 22 into which a parasitic conductor 21 is inserted, an antenna holder 23, and a cap part 20. Furthermore, the conductive antenna holder 23 which is made of for example a metal, has a screw part 23*b* formed on the outer circumferential surface, and has a recessed insertion part formed in the upper surface. The lower part of the antenna bobbin 22 is inserted into this insertion part. Furthermore, a through-hole is formed which forms a through-hole 4*a* substantially along the central axis. The antenna bobbin 22 is formed from an insulating material such as a synthetic resin or the like, and formed with a substantially circular cross-sectional shape. The pattern of an antenna element which resonates in a plurality of frequency bands shown in FIG. 5 or FIG. 6 is formed on the outer circumferential surface of the antenna bobbin 22. This pattern is formed on the outer circumferential surface of the antenna bobbin 22 by conductive foil printing, conductive powder vacuum evaporation, plating or the like, and is formed as a ring-form pattern on the lower part of the antenna bobbin 22 as shown in FIG. 5 or FIG. 6. This ring-form pattern is electrically connected to the antenna holder 23 when the antenna bobbin 22 is inserted into the insertion part of the antenna holder 23.

A through-hole which forms a through-hole 4*a* substantially along the central axis is formed in the antenna bobbin 22 which is fastened to the antenna holder 23. A conductive parasitic conductor 21 made of e.g. a metal which has a substantially cylindrical shape is inserted into this through-hole so that this conductor 21 substantially corresponds to the position where the patterned antenna element is formed. Furthermore, an insulating cap part 20 made of e.g. a synthetic resin is mounted on the antenna bobbin 22 so that this cap part 20 covers the entire antenna bobbin 22, and an engaging part formed on the lower part of the cap part 20 is engaged with and fastened to the upper part of the antenna holder 23. A retractable antenna part 5 is built into the fixed antenna part 4 so that this retractable antenna part 5 can freely slide through the through-hole 4*a* formed in the fixed antenna part 4 thus constructed.

The retractable antenna part 5 is constructed from a conductive whip part 5*a* which is made of e.g. a superelastic metal, an insulating part 6 made of a resin which is formed as an integral part of the upper end of the whip part 5*a*, and a conductive stopper 8 which is made of e.g. a metal, and which is fastened to the lower end of the whip part 5*a*. Furthermore, a conductive expanded-diameter part 5*b* made of e.g. a metal, in which the outer diameter is increased, is disposed at an intermediate point on the whip part 5*a*. The state shown in FIGS. 9 and 10 is a sate in which the retractable antenna part 5 is extended with respect to the fixed antenna part 4; in this state, a flange part 8*a* formed on the lower end of the stopper 8 abuts against the lower end of the antenna holder 23. As a result, the retractable-antenna part 5 is not extended any further, and is prevented from slipping out by the flange part 8*a*. Furthermore, the main body part of the stopper 8 is inserted into the through-hole 4*a*, and is held by a holding spring 9 that is inserted into the through-hole of the antenna holder 23. As a result, the retractable antenna part 5 is held in an extended state.

When the retractable antenna part 5 is extended, the whip part 5*a* is electrically connected to the antenna holder 23 via the stopper 8, so that the retractable antenna part 5 and fixed antenna part 4 are both placed in an operating state. In this case, the retractable antenna part 5 and fixed antenna part 4 influence each other. Accordingly, as is shown in FIG. 10, the system is arranged so that when the retractable antenna part 5 is extended, the expanded-diameter part 5*b* disposed at an intermediate point on the whip part 5*a* is positioned inside the parasitic conductor 21. As a result, in the mobile phone antenna 3 as a whole, the electrical characteristics are improved to good electrical characteristics in for example the three frequency bands of the AMPS system, PCS system and GPS system, so that an antenna that can operate in these three frequency bands is obtained. Furthermore, since the impedance of the extended mobile phone antenna 3 is approximately 50 Ω in the operable frequency bands, a matching circuit for matching with the RF circuit 1*e* can be omitted. Moreover, since the retractable antenna part 5 and fixed antenna part 4 are both in an operating state, the overall length of the whip part 5*a* can be shortened compared to the wavelength of the AMPS system, so that the total length of the mobile phone antenna 3 can also be shortened.

Furthermore, the state shown in FIG. 11 is a state in which the retractable antenna part 5 is retracted with respect to the fixed antenna part 4; here, the under surface of a top part 7 formed on the tip end of the insulating part 6 that is formed as an integral part of the tip end of the whip part 5*a* abuts against the upper surface of the cap part 20. As a result, the retractable antenna part 5 is not retracted any further, and the insulating part 6 is positioned inside the through-hole 4*a* of the fixed antenna part 4. Accordingly, because of the action of the insulating part 6, the fixed antenna part 4 is not influenced by the retractable antenna part 5; furthermore, the retractable antenna part 5 does not operate, so that only the fixed antenna part 4 operates. In cases where the fixed antenna part 4 operates independently, this fixed antenna part 4 operates in the same manner as the fixed antenna part 2. Accordingly, the pattern of the antenna element formed on the outer circumferential surface of the antenna bobbin 22 is influenced by the parasitic conductor 21, so that for example good electrical characteristics are obtained in the frequency bands of the AMPS system, PCS system and GPS system, and the antenna can operate in these three frequency bands. Furthermore, since the impedance of the fixed antenna part 4 is approximately 50 Ω in the operable frequency bands, a matching circuit for matching with the RF circuit 1*e* can be omitted.

Here, the effect of the parasitic conductor 21 will be illustrated by comparing a case in which a parasitic conductor 21 is not installed and a case in which a parasitic conductor 21 is installed.

Figure 16:
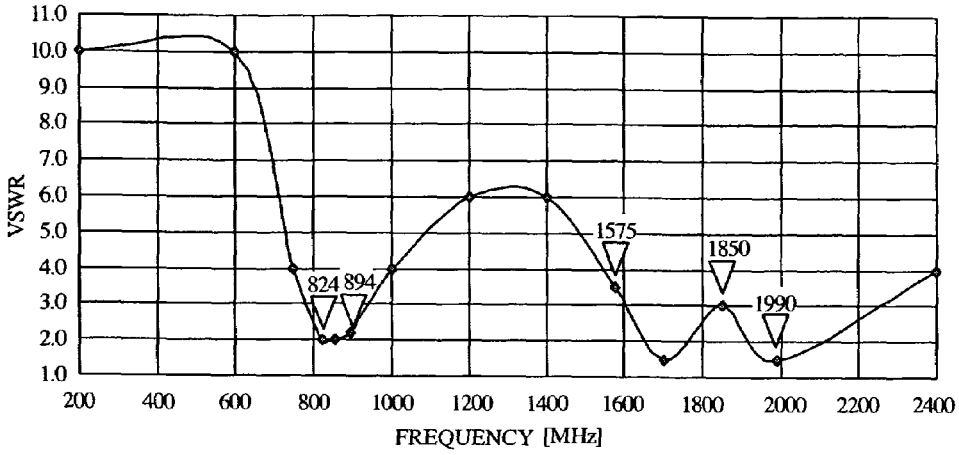
FIG. 16 is a graph showing the VSWR frequency characteristics when the retractable antenna part is extended in a mobile phone antenna in which no parasitic element is installed.
Figure 17:
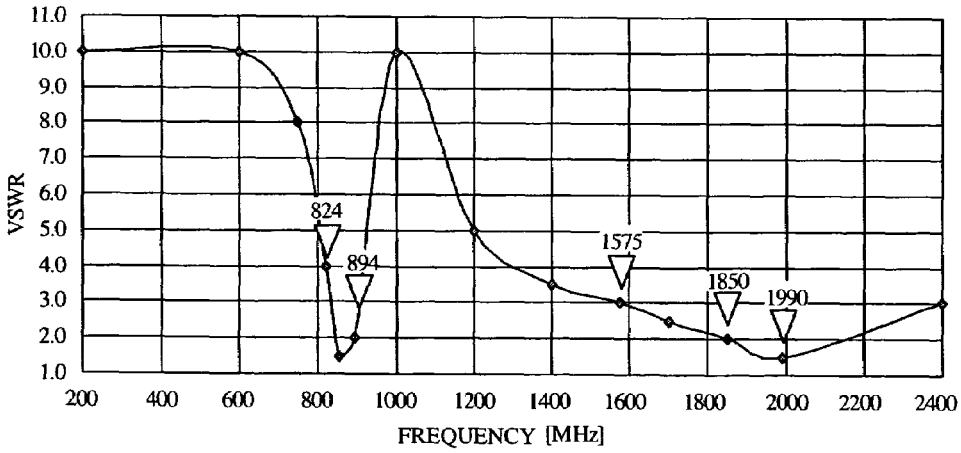
FIG. 17 is a graph showing the VSWR frequency characteristics when the retractable antenna part is retracted in a mobile phone antenna in which no parasitic element is installed.
Figure 18:
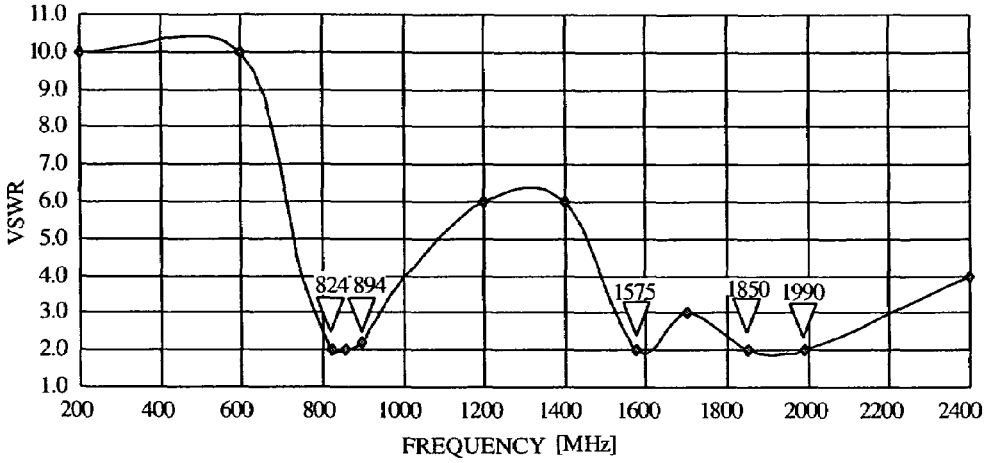
FIG. 18 is a graph showing the VSWR frequency characteristics when the retractable antenna part is extended in a mobile phone antenna constituting an embodiment of the present invention.
Figure 19:
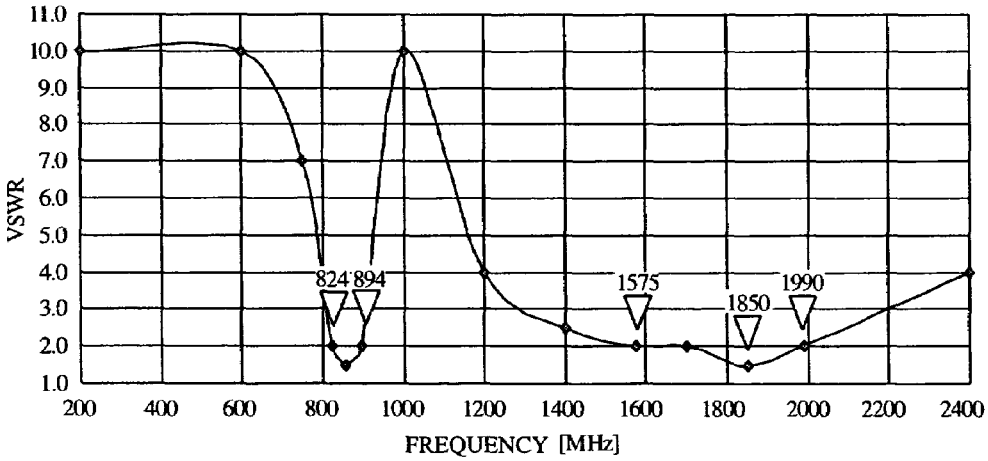
FIG. 19 is a graph showing the VSWR frequency characteristics when the retractable antenna part is retracted in a mobile phone antenna constituting an embodiment of the present invention.

The frequency characteristics of the voltage-standing wave ratio (VSWR) in a case where the retractable antenna part 5 is extended in a mobile phone antenna 3 in which no parasitic conductor 21 is installed are shown in FIG. 16, and the VSWR frequency characteristics in a case where the retractable antenna part 5 is retracted in the same antenna are shown in FIG. 17. Furthermore, the VSWR frequency characteristics in a case where the retractable antenna part 5 is extended in a mobile phone antenna 3 in which a parasitic conductor 21 is installed are shown in FIG. 18, and the VSWR frequency characteristics in a case where the retractable antenna part 5 is retracted in the same antenna are shown in FIG. 19. In FIGS. 16 through 19, the frequency band from 824 MHz to 894 MHz is the frequency band of the AMPS system, the frequency band from 1850 MHz to 1990 MHz is the frequency band of the PCS system, and 1575 MHz is the frequency band of the GPS system.

When the retractable antenna part 5 is extended in a mobile phone antenna 3 in which no parasitic conductor 21 is installed, as is shown in FIG. 16, the VSWR is approximately 3 or less in the frequency bands of the AMPS system and PCS system; however the VSWR deteriorates to approximately 3.5 in the frequency band of the GPS system. Furthermore, when the retractable antenna part 5 is retracted, as is shown in FIG. 17, the VSWR is approximately 3 or less in the frequency bands of the GPS system and PCS system; however, the VSWR deteriorates to approximately 4 or less in the frequency band of the AMPS system.

On the other hand, when the retractable antenna part 5 is extended in a mobile phone antenna 3 in which a parasitic conductor 21 is installed, as is shown in FIG. 18, the VSWR is improved to approximately 2.1 or less in the frequency bands of the AMPS system and PCS system, and is also improved to approximately 2.0 in the frequency band of the GPS system. Furthermore, when the retractable antenna part 5 is retracted as well, as is shown in FIG. 19, the VSWR is improved to 2.0 or less in the frequency bands of the AMPS system and PCS system, and is improved to approximately 2.0 in the frequency band of the GPS system.

Thus, it is seen that as a result of the installation of the parasitic conductor 21, the electrical characteristics are improved to good electrical characteristics in the three frequency bands of the AMPS system, PCS system and GPS system, and a mobile phone antenna 3 that can operate in these three frequency bands is obtained.

Furthermore, the effect of the parasitic conductor 11 in the fixed antenna part 2 shown in FIGS. 3 and 4 is also similar; as a result of the installation of this parasitic conductor 11, the electrical characteristics are improved to good electrical characteristics that are substantially similar to the VSWR characteristics shown in FIG. 19.

Figure 12:
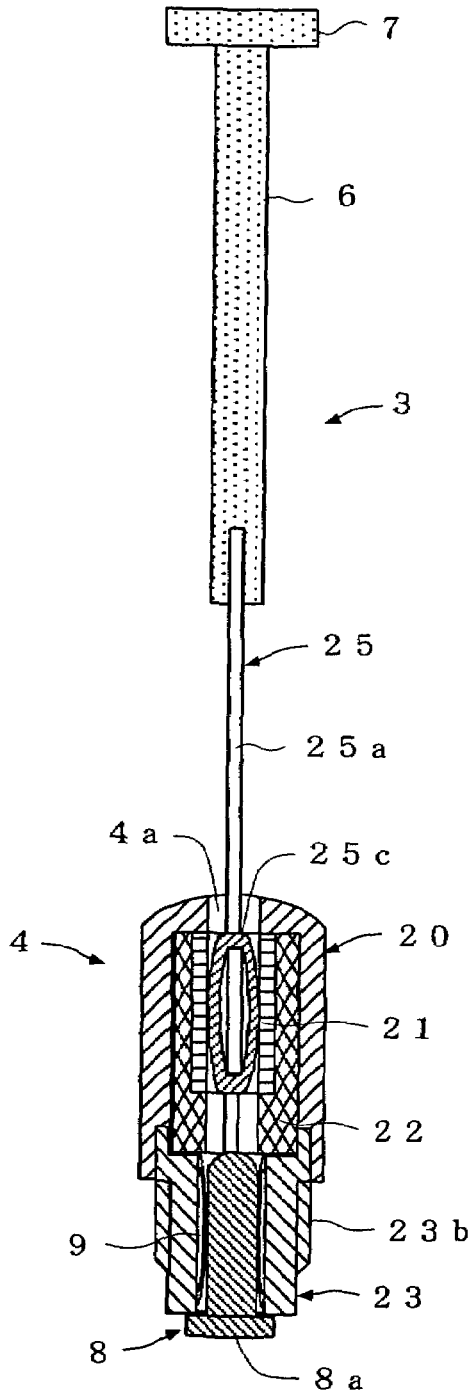
FIG. 12 is a diagram showing the construction when the retractable antenna part is extended in a mobile phone antenna of a second construction constituting an embodiment of the present invention.
Figure 13:
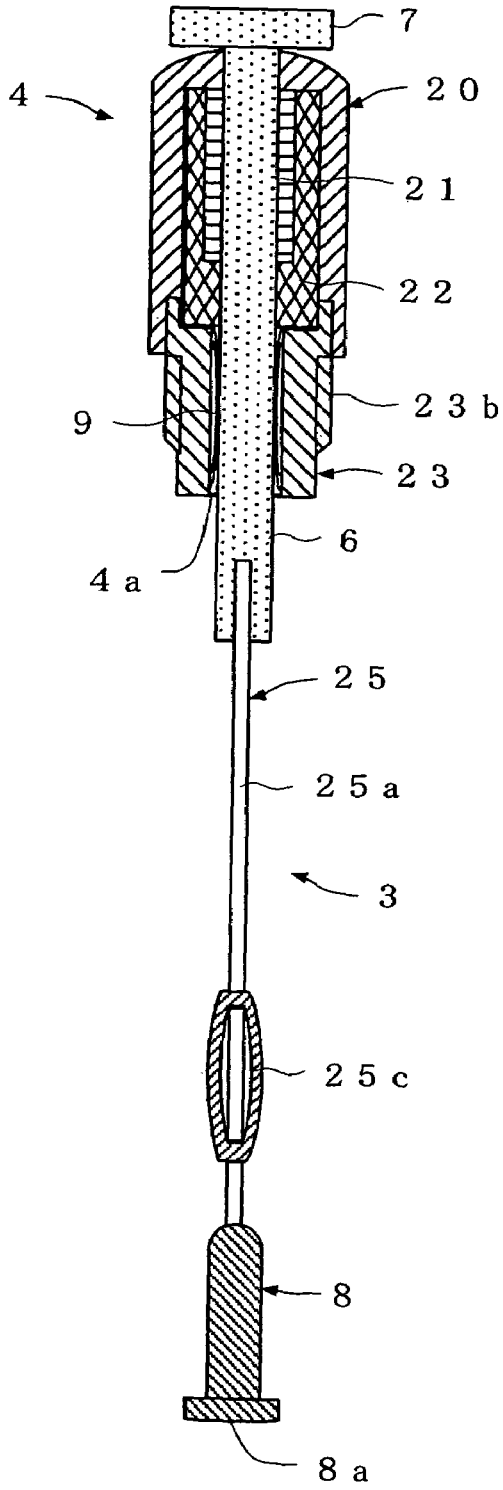
FIG. 13 is a diagram showing the construction when the retractable antenna part is retracted in a mobile phone antenna of a second construction constituting an embodiment of the present invention.

Next, a sectional view of a state in which the retractable antenna part is extended in a second construction of the mobile phone antenna 3 of the present invention is shown in FIG. 12, and a sectional view of a state in which the retractable antenna part is retracted in this same construction is shown in FIG. 13.

In the second construction of the mobile phone antenna 3 of the present invention shown in these figures, the construction of the fixed antenna part 4 is similar to that of the fixed antenna part 4 in the mobile phone antenna 3 shown in FIGS. 11 and 12, and the construction of the retractable antenna part 25 is altered. Accordingly, the construction of the retractable antenna part 25 will be described below.

The retractable antenna part 25 is constructed from a conductive whip part 25*a* which is made of for example a superelastic metal, an insulating part 6 made of a resin which is formed as an integral part of the upper end of the whip part 25*a*, and a conductive stopper 8 made of for example a metal which is fastened to the lower end of the whip part 25*a*. Furthermore, a conductive spring part 25*c* made of for example a metal whose outer diameter is increased is disposed at an intermediate point on the whip part 25*a*. The state shown in FIG. 12 is a state in which the retractable antenna part 25 is extended with respect to the fixed antenna part 4, and the flange part 8*a* formed on the lower end of the stopper 8 abuts against the lower end of the antenna holder 23. As a result, the retractable antenna part 25 is not extended any further, and is prevented from slipping out by the flange part 8*a*. Furthermore, the main body part of the stopper 8 is inserted into the through-hole 4*a*, and is held by a holding spring 9 that is inserted into the through-hole of the antenna holder 23. Moreover, the spring part 25*c* disposed at an intermediate point on the whip part 25*a* is pressed against the inner circumferential surface of the parasitic conductor 21. As a result, the retractable antenna part 25 is held in an extended state.

When the retractable antenna part 25 is extended, since the retractable antenna part 25*a* is electrically connected to the antenna holder 23 via the stopper 8, the retractable antenna part 25 and the fixed antenna part 4 are both placed in an operating state. In this case, the retractable antenna part 25 and fixed antenna part 4 influence each other. Accordingly, as is shown in FIG. 12, the system is devised so that when the retractable antenna part 25 is extended, the spring part 25*c* which is disposed at an intermediate point on the whip part 25*a* is caused to contact the inner circumferential surface of the parasitic conductor 21. As a result, the electrical characteristics of the mobile phone antenna 3 as a whole are improved to good electrical characteristics in the three frequency bands of the AMPS system, PCS system and GPS system. Furthermore, since the impedance of the extended mobile phone antenna is approximately 50 Ω in the operable frequency bands, the need for a matching circuit to match with the RF circuit 1*e* can be eliminated. Furthermore, since the retractable antenna part 25 and fixed antenna part 4 are both in an operating state, the overall length of the whip part 25*a* can be shortened compared to the wavelength of the AMPS system, and the total length of the mobile phone antenna 3 can also be shortened.

Furthermore, the state shown in FIG. 13 is a state in which the retractable antenna part 25 is retracted with respect to the fixed antenna part 4; here, the undersurface of the top part 7 formed on the tip end of the insulating part 6 which is formed as an integral part of the tip end of the whip part 25*a* abuts against the upper surface of the cap part 20. As a result, the retractable antenna part 25 is not retracted any further, and the insulating part 6 is positioned inside the through-hole 4*a* of the fixed antenna part 4. Accordingly, as a result of the action of the insulating part 6, the fixed antenna part 4 is not influenced by the retractable antenna part 25, and the retractable antenna part 25 does not operate, so that only the fixed antenna part 4 operates. In cases where the fixed antenna part 4 operates independently, this fixed antenna part 4 operates in the same manner as the abovementioned fixed antenna part 2; accordingly, the pattern of the antenna element formed on the outer circumferential surface of the antenna bobbin 22 is influenced by the parasitic conductor 21, so that good electrical characteristics are obtained in the frequency bands of for example the AMPS system, PCS system and GPS system, and the antenna can operate in these three frequency bands. Furthermore, since the impedance of the fixed antenna part 4 is approximately 50 Ω in the operable frequency bands, the need for a matching circuit to match with the RF circuit 1*e* can be eliminated.

Furthermore, when the retractable antenna part 25 is extended as shown in FIG. 12, the VSWR frequency characteristics of the mobile phone antenna 3 of the second construction are as shown in FIG. 18. Furthermore, when the retractable antenna part 25 is retracted as shown in FIG. 13, the VSWR frequency characteristics of the mobile phone antenna 3 of the second construction are as shown in FIG. 19. Thus, as a result of the action of the parasitic conductor 21, the frequency characteristics are improved to good frequency characteristics in the three frequency bands of the AMPS system, PCS system and GPS system, so that a mobile phone antenna 3 that can operate in these three frequency bands is obtained.

Figure 14:
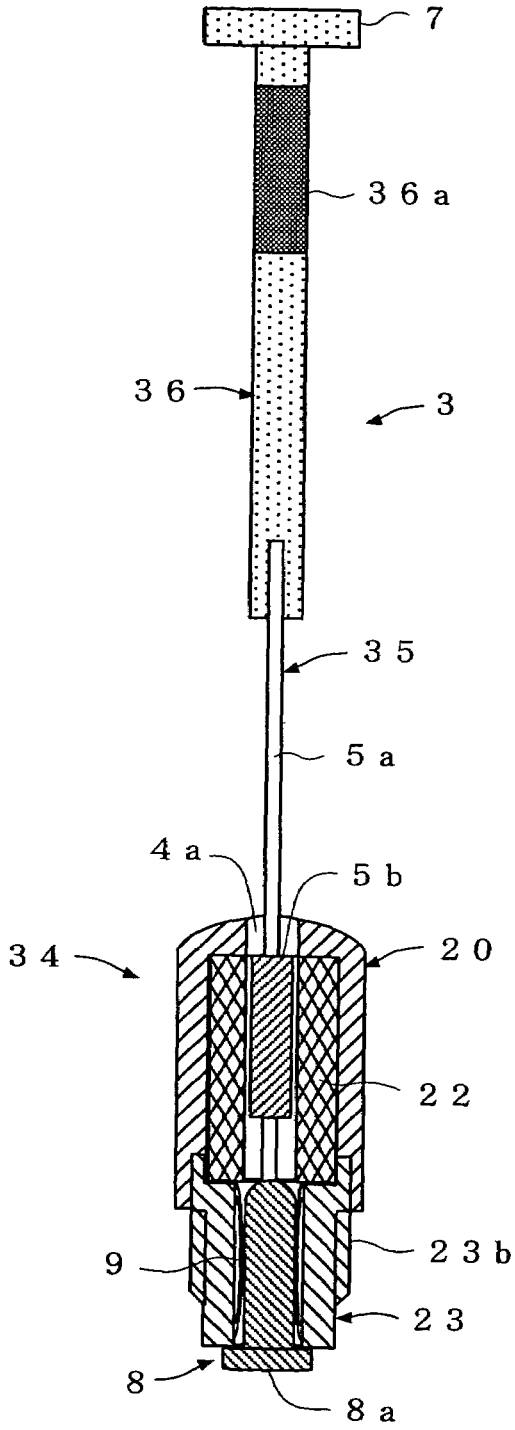
FIG. 14 is a diagram showing the construction when the retractable antenna part is extended in a mobile phone antenna of a third construction constituting an embodiment of the present invention.
Figure 15:
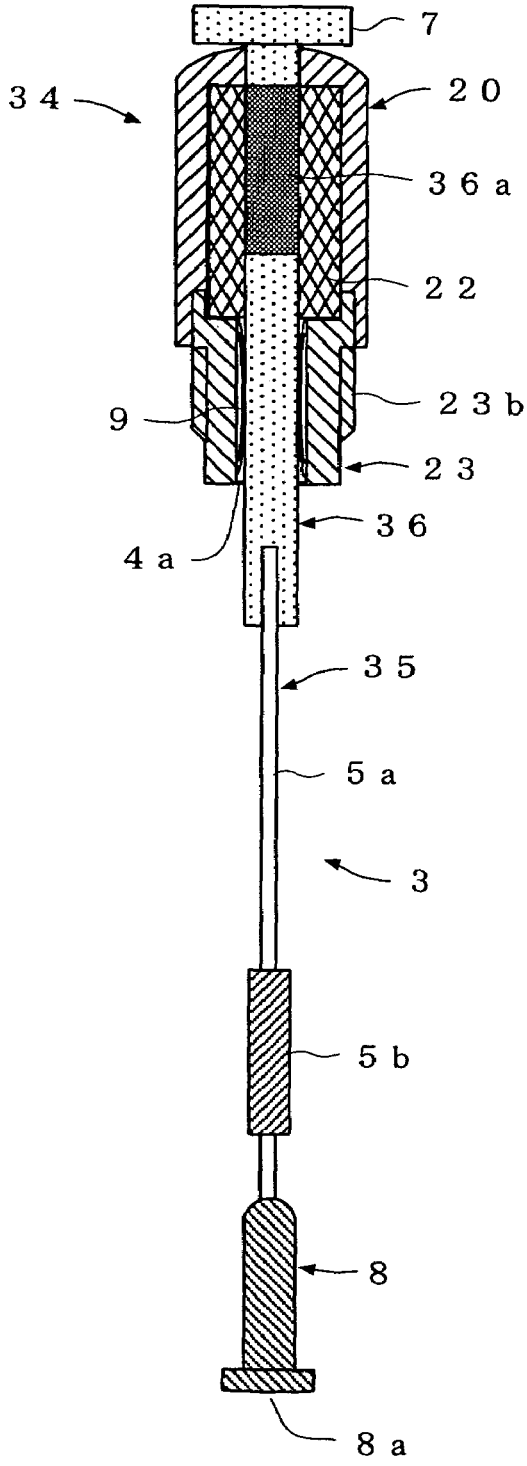
FIG. 15 is a diagram showing the construction when the retractable antenna part is retracted in a mobile phone antenna of a third construction constituting an embodiment of the present invention.

Next, a sectional view of a state in which the retractable antenna part is extended in a third construction of the mobile phone antenna 3 of the present invention is shown in FIG. 14, and a sectional view of a state in which the retractable antenna part is retracted in the same construction is shown in FIG. 15.

In the third construction of the mobile phone antenna 3 of the present invention shown in these figures, the parasitic conductor that was previously mounted inside the antenna bobbin 22 in the fixed antenna part 34 is omitted; the remaining construction is similar to that of the fixed antenna part 4 in the mobile phone antenna 3 shown in FIGS. 11 and 12. Furthermore, a parasitic conductor 36*a* is formed on the insulating part 36 in the retractable antenna part 35. Accordingly, mainly the construction of the retractable antenna part 35 will be described below.

The retractable antenna part 35 is constructed from a conductive whip part 5*a* which is made of e.g. a superelastic metal, an insulating part 36 made of a resin which is formed as an integral part of the upper end of the whip part 5*a*, and a conductive stopper 8 which is made of e.g. a metal, and which is fastened to the lower end of the whip part 5*a*. Furthermore, a conductive expanded-diameter part 5*b* which is made of e.g. a metal, and which has an increased outer diameter, is disposed at an intermediate point on the whip part 5*a*. The state shown in FIG. 14 is a state in which the retractable antenna part 35 is extended with respect to the fixed antenna part 34; here, a flange part 8*a* formed on the lower end of the stopper 8 abuts against the lower end of the antenna holder 23. As a result, the retractable antenna part 35 is not extended any further, and is prevented from slipping out by the flange part 8*a*. Furthermore, the main body part of the stopper 8 is inserted into the through-hole 4*a*, and is held by a holding spring 9 that is inserted into the through-hole of the antenna holder 23. As a result, the retractable antenna part 35 is held in an extended state.

When the retractable antenna part 35 is extended, since the retractable antenna part 35*a* is electrically connected to the antenna holder 23 via the stopper 8, both the retractable antenna part 35 and the fixed antenna part 34 are placed in an operating state. In this case, the retractable antenna part 35 and fixed antenna part 34 influence each other. Accordingly, as is shown in FIG. 14, the system is arranged so that when the retractable antenna part 35 is extended, the expanded-diameter part 5*b* disposed at an intermediate point on the whip part 5*a* is positioned inside the antenna bobbin 12. In this case, the expanded-diameter part 5*b* also exhibits the effect of the abovementioned parasitic conductor; as a result, in the mobile phone antenna 3 as a whole, the electrical characteristics are improved to good electrical characteristics in for example the three frequency bands of the AMPS system, PCS system and GPS system, so that an antenna that can operate in these three frequency bands is obtained. Furthermore, since the impedance of the extended mobile phone antenna 3 is approximately 50 Ω in the operable frequency bands, the need for a matching circuit to match with the RF circuit 1*e* can be eliminated. Moreover, since the retractable antenna part 35 and fixed antenna part 34 are both in an operating state, the overall length of the whip part 5*a* can be shortened compared to the wavelength of the AMPS system, so that the total length of the mobile phone antenna 3 can also be shortened.

Furthermore, the state shown in FIG. 15 is a state in which the retractable antenna part 35 is retracted with respect to the fixed antenna part 34; here, the undersurface of the top part 7 formed on the tip end of the insulating part 36 which is formed as an integral part of the tip end of the whip part 5*a* abuts against the upper surface of the cap part 20. As a result, the retractable antenna part 35 is not retracted any further, and the parasitic conductor 36*a* formed at an intermediate point on the insulating part 36 is positioned inside the through-hole 4*a* of the fixed antenna part 34. Accordingly, the retractable antenna part 35 does not operate, so that only the fixed antenna part 34 operates. Furthermore, since the parasitic conductor 36*a* is positioned inside the through-hole 4*a* of the fixed antenna part 34, the pattern of the antenna element formed on the outer circumferential surface of the antenna bobbin 22 is influenced by the parasitic conductor 36*a*, so that the electrical characteristics are improved to good electrical characteristics in for example the frequency bands of the AMPS system, PCS system and GPS system, and the antenna can operate in these three frequency bands. Furthermore, since the impedance of the fixed antenna part 34 is approximately 50 Ω in the operable frequency bands, the need for a matching circuit to match with the RF circuit 1*e* can be eliminated. Moreover, the parasitic conductor 36*a* can be constructed from a pipe-form metal tube; however, this conductor may also be formed as a conductive film in a specified position on the outer circumferential surface of the insulating part 36 by conductive foil printing, conductive powder vacuum evaporation, plating or the like.

Furthermore, when the retractable antenna part 35 is extended as shown in FIG. 14, the VSWR frequency characteristics of the mobile phone antenna 3 of the third construction are as shown in FIG. 18. Moreover, when the retractable antenna part 35 is retracted as shown in FIG. 15, the VSWR frequency characteristics of the mobile phone antenna 3 of the third construction are as shown in FIG. 19. Thus, the electrical characteristics are improved to good electrical characteristics in the three frequency bands of the AMPS system, PCS system and GPS system by the action of the expanded-diameter part 5*b* or parasitic conductor 36*a*, so that a mobile phone antenna 3 that can operate in these three frequency bands is obtained.

In the fixed antenna part 2 described above, instead of inserting a parasitic conductor 11 into the accommodating hole 12*a* formed in the antenna bobbin 12, it would also be possible to form a conductive film 12*a* on the inner circumferential surface of the accommodating hole 12*a* by conductive foil printing, conductive powder vacuum evaporation, plating or the like. Furthermore, in the fixed antenna parts 4 or 34 described above, instead of inserting a parasitic conductor 21 into the through-hole formed in the antenna bobbin 22 or installing a parasitic conductor 36*a* on the insulating part 36, it would also be possible to form a conductive film on the inner circumferential surface of the through-hole in the antenna bobbin 22 by conductive foil printing, conductive powder vacuum evaporation, plating or the like.

INDUSTRIAL APPLICABILITY

As was described above, since a conductive parasitic conductor is inserted into the accommodating hole of an insulating antenna bobbin on which the pattern of an element that resonates in a plurality of frequency bands is formed, a multiple resonance antenna with good electrical characteristics which can be operated in a plurality of frequency bands can be obtained. Furthermore, this antenna can be made compact.

Moreover, if such a multiple resonance antenna is formed so that this antenna can be fastened to a housing as a fixed antenna part, and a mobile phone antenna is constructed from this fixed antenna part and a retractable antenna part which passes through the fixed antenna part and is retractable with respect to this fixed antenna part, a compact mobile phone antenna with good electrical characteristics which can be operated in a plurality of frequency bands can be obtained. In this case, the electrical characteristics in the retracted state can be further improved by positioning an expanded-diameter part formed at an intermediate point on the retractable antenna part inside the through-hole in the antenna bobbin when the retractable antenna part is extended.

What is claimed is:

1. A multiple resonance antenna comprising an insulating antenna bobbin with a lower part and upper part and with an inner circumferential surface and an outer circumferential surface; which has a pattern of an element that resonates in a plurality of frequency bands formed on the outer circumferential surface of the insulating antenna bobbin; and a conductive parasitic conductor with an inner circumferential surface and an outer circumferential surface which is inserted into an accommodating hole formed by the inner circumferential surface of the insulating antenna bobbin, which is substantially along the central axis of the insulating antenna bobbin, and the lower part of the insulating antenna bobbin is engaged with a conductive antenna holder, the antenna holder and the element are electrically connected, and an insulating cap part that covers the insulating antenna bobbin is mounted on the upper part of the antenna holder.

2. The multiple resonance antenna according to claim 1, wherein the pattern of the element is folded back to form a folded portion and short-circuiting parts between the folded-back portion of the pattern.

3. A mobile phone antenna comprising:

a fixed antenna part which is fastenable to a housing of a mobile phone; and a retractable antenna part, which passes through the fixed antenna part, and is retractable with respect to the fixed antenna part;

wherein the fixed antenna part is constructed from an insulating antenna bobbin with an inner circumferential surface and an outer circumferential surface; which has a pattern of an element that resonates in a plurality of frequency bands formed on the outer circumferential surface of the antenna bobbin; and a conductive parasitic conductor with an inner circumferential surface and an outer circumferential surface which is inserted into a through-hole formed by the inner circumferential surface of the insulating antenna bobbin, a conductive antenna holder with which the lower part of the antenna bobbin is engaged, and to which the element is electrically connected, and an insulating cap part which covers the antenna bobbin, and the retractable antenna part is constructed from a whip part, a conductive stopper which is disposed on the lower end of the whip part and which is held inside an antenna through-hole formed substantially along the central axis of the fixed antenna part when the retractable antenna part is extended, and an insulative insulating part which is disposed on the tip end of the whip part, and which is positioned inside the antenna through-hole when the retractable antenna part is retracted.

4. The mobile phone antenna according to claim 3, wherein a conductive expanded-diameter part is disposed at an intermediate point on the whip part, and the expanded-diameter part is positioned inside a through-hole in the antenna bobbin when the whip part is extended.

5. The mobile phone antenna according to claim 3, wherein a conductive part is disposed, instead of the parasitic conductor, on a portion of the insulating part that is positioned inside the antenna through-hole in the retracted state.

6. The mobile phone antenna according to claim 4, wherein a conductive contact spring that contacts the inside of a through-hole in the parasitic conductor when the whip part is extended is installed instead of the expanded-diameter part.

7. The mobile phone antenna according to claim 3, wherein a conductive film is formed, instead of the parasitic conductor, on the inner circumferential surface of a through-hole in the antenna bobbin.

* * * * *